United States Patent [19]

Zahn et al.

[11] 3,991,452

[45] Nov. 16, 1976

[54] APPARATUS FOR FORMING A DISCONNECT TERMINAL

[75] Inventors: Irwin Zahn, New York; Renate Rosenberg, Forest Hills, both of N.Y.

[73] Assignee: General Staple Company, New York, N.Y.

[22] Filed: Mar. 28, 1975

[21] Appl. No.: 563,170

[52] U.S. Cl. ..... 29/33 M; 29/203 DS; 29/203 DT; 29/628

[51] Int. Cl.[2] ..... H01R 43/04

[58] Field of Search ..... 29/33 E, 33 M, 33.5, 29/203 D, 203 DT, 203 DS, 628; 113/119

[56] References Cited

UNITED STATES PATENTS

| | | | |
|---|---|---|---|
| 2,783,813 | 3/1957 | Duks | 29/203 DT |
| 3,239,924 | 3/1966 | Wagner | 29/203 DT |
| 3,605,261 | 9/1971 | Zahn et al. | 29/203 D X |
| 3,636,611 | 1/1972 | Rosenbaum | 29/203 D |
| 3,849,860 | 11/1974 | Zahn et al. | 29/203 DS |

*Primary Examiner*—Othell M. Simpson
*Assistant Examiner*—Fred A. Silverberg
*Attorney, Agent, or Firm*—Lerner David Littenberg & Samuel

[57] ABSTRACT

Apparatus is disclosed for forming a disconnect terminal from a supply band having a continuous first portion and a plurality of second portions spaced therealong and integrally connected to the first portion. The apparatus comprises first means for shearing the continuous first portion of the supply band at a location intermediate two adjacent second portions thereof to form a predetermined length of said supply band into a predetermined shape having a terminal portion and an integrally connected connector portion. Second means are provided for bending the length into a generally U-shaped configuration. A die is provided which has first and second receptacles therein. The first receptacle has a first predetermined configuration for the reception of at least one wire therein, and the second receptacle has a second predetermined configuration for forming the terminal portion of the predetermined length of the supply band into a preselected terminal configuration. Third means are provided for driving the length into the die whereby the connector portion will be crimped about the wire received in the first receptacle and ther terminal portion of the length will be formed into the preselected terminal configuration in the second receptacle of the die. In accordance with the invention, the preformed supply band may be manufactured separately or it may be formed in situ by the apparatus from a continuous planar supply strip.

24 Claims, 14 Drawing Figures

APPARATUS FOR FORMING A DISCONNECT TERMINAL

In further accordance with the invention, the preformed supply band may further include a plurality of third portions integrally connected to respective ones of the second portions (either previously manufactured or formed in situ by the apparatus) with said third portions defining strain relief portions of the said predetermined length. In this embodiment, the die includes a third receptacle for the reception of the insulated portion of the wire to which the terminal is being attached and for the reception of the said strain relief portion of the said predetermined length for crimping the strain relief portion about the insulated portion of the wire.

BACKGROUND OF THE INVENTION

In U.S. Pat. No. 3,636,611, issued Jan. 25, 1972, to Irving W. Rosenbaum entitled APPARATUS FOR SPLICING WIRES and assigned to the assignee of the instant invention, there is disclosed apparatus for automatically forming, driving and crimping an electrically conductive splice about a pair of wires which are to be mechanically and electrically connected thereby. As mentioned in the Rosenbaum patent, a significant advantage of the apparatus described therein is the fact the apparatus employs a continuous supply strip and automatically forms, drives and crimps the splice formed therefrom in one continuous operation. This is in contrast to the prior art techniques which preceded the Rosenbaum patent in which a first manufacturing step was employed to produce a string of preformed splices (much like a string of conventional U-shaped staples employed in a desk top stapler), and a separate apparatus had to be employed to drive such preformed splices about the pair of wires to be joined thereby.

Similarly, in U.S. Pat. No. 3,605,261 issued Sept. 20, 1971, to I. Zahn, et al, and assigned to the assignee of the instant invention, there is disclosed apparatus for automatically forming, driving and crimping a ring-type terminal about the end of a wire in one, continuous operation and with the employment of a continuous supply strip.

SUMMARY OF THE INVENTION

The instant invention represents an improvement over the aforementioned patents and provides an apparatus for forming and applying a quick disconnect terminal about one or more wires wherein, like the apparatus of the aforenoted patents, the terminal is formed, driven and clinched in one, continuous operation and with the use of a continuous supply strip. In one embodiment of the invention, the continuous supply strip takes the form of a prepunched splice band having the necessary preconfigured portions to establish the connector portion and the terminal portion of the ultimate terminal being attached to one or more wires. In another embodiment of the invention, the prepunched splice band having the desired beginning configuration may actually be established by forming means associated with and operating in conjunction with the main portions of the apparatus.

In yet another embodiment of the invention, either the preformed splice band, or the splice band formed in situ from a continuous planar supply strip may be provided with a third, strain relief portion, which is eventually crimped about the insulated portion of the wire to which the terminal is being attached to provide mechanical integrity with respect thereto.

The quick disconnect terminal formed and attached to one or more wires by the instant invention may have any desired configuration depending upon the terminal post to which it is ultimately to be connected. Thus, if the terminal post is "male", the terminal portion of the quick disconnect terminal would be of complementary shaped "female" configuration adapted to telescopically engage the male terminal post. In accordance with a further aspect of the invention, a preselected female terminal configuration is formed by providing the complementary male form in the appropriate receptacle of the aforementioned die and bending the terminal portion of the preselected length of said supply band thereabout. In accordance with a further feature, the male form is established by two cooperating half forms which are normally biased toward an eject position to facilitate removal of the female configuration bent thereabout. During the actual driving stage, the two half forms are spread apart into their desired male form about which the quick disconnect terminal portion is formed.

Accordingly, it is an object of the instant invention to provide apparatus for forming a disconnect terminal from a preformed supply band which may be either manufactured beforehand of formed in situ by the apparatus.

Another object of the instant invention is to provide such apparatus and supply band therefor which is capable of providing a quick disconnect terminal having, in addition, a strain relief portion thereof.

Another object of the instant invention is to provide a preformed supply band for use in such an apparatus.

Another object of the invention is to provide a novel die for use in forming a disconnect terminal.

Other objects of the instant invention and a fuller understanding thereof may be had by referring to the following detailed description and drawings.

DETAILED DESCRIPTION

As noted at the outset, a significant portion of the apparatus of the instant invention is, in many respects, similar to the apparatus disclosed in U.S. Pat. No. 3,636,611. In other respects, the apparatus hereof is similar in subject matter to the apparatus disclosed in U.S. Pat. No. 3,605,261. In still other respects, directed to the feature of providing the disconnect terminal hereof with the strain relief portion, the invention hereof is related and similar to apparatus disclosed and claimed in U.S. Pat. No. 3,849,860, and assigned to the assignee of the present invention. Thus, by specific reference thereto, the instant disclosure incorporates herein the subject matter of U.S. Pat Nos. 3,636,611; 3,605,261 and 3,849,860. To facilitate explanation, the following detailed description will be primarily directed to the construction and operation of those portions of the overall apparatus which will highlight the inventive features hereof.

Figure 1:
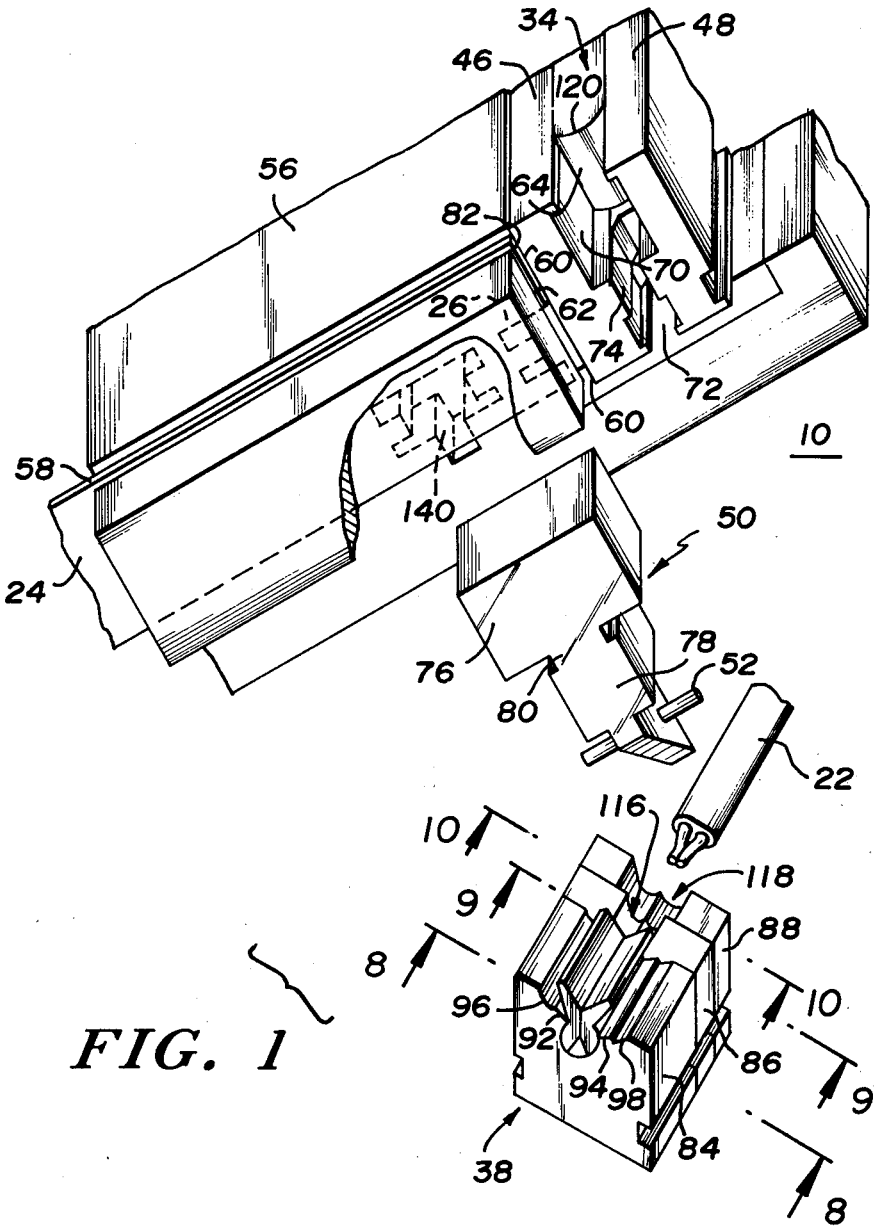
FIG. 1 is an exploded perspective view of apparatus constructed in accordance with the instant invention.
Figure 3:
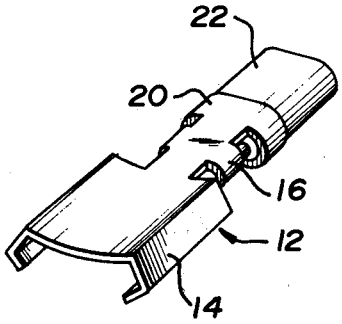
FIG. 3 is a perspective view of a disconnect terminal formed in accordance with the instant invention.
Figure 4:
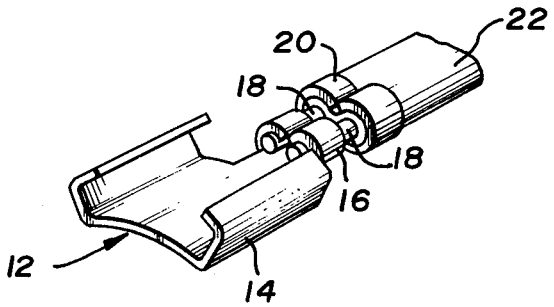
FIG. 4 is a perspective view of the disconnect terminal illustrated in FIG. 3, but viewed from underneath thereof.

Turning to the figures, wherein like numerals designate like parts, there is shown in FIG. 1 apparatus 10 for forming a disconnect terminal 12 shown in FIGS. 3 and 4. Before going into detail, it may be noted from a consideration of FIGS. 3 and 4, that so far as the broad concepts of the instant invention are concerned, the disconnect terminal 12 includes two basic portions designated a terminal portion 14 and a connector portion 16. The terminal portion 14 is so shaped, in a manner to be further described, to be easily and quickly connected and disconnected to a complementary shaped male terminal post (not shown). The connector portion 16 is, in a manner to be further described, crimped about one or more wires 18 to which the disconnect terminal 12 is to be attached. It is to be understood that the disconnect terminal 12 of the instant invention has application in any environment in which it is desirable to provide an electrical connection from the wire or wires 18 to a male terminal post. Also, it will be appreciated that although two wires, 18, happen to be disclosed being joined in electrical parallel to the terminal portion 14, the instant invention has equal applicability in an environment where only one such wire 18 is being joined to the terminal portion 14.

As a particularly advantageous feature of the instant invention, the disconnect terminal 12 may be provide with a third portion 20, designated a strain relief portion, which, in a manner to be further described, is crimped about the insulation 22 of the wire or wires to which the disconnect terminal is being attached. As explained in greater detail in the aforementioned U.S. Pat. No. 3,849,860, the strain relief portion 20 integrally connected to the connector portion 16 digs into the rather soft insulation 22 and prevents the disconnect terminal 12 from being easily pulled off of the wire or wires 18.

As will be further described in greater detail, the disconnect terminal 12 of the instant invention is formed, driven and clinched in one continuous operation from a continuous supply stock. In the embodiment of the invention where the strain relief portion is being employed, the supply stock may constitute a preformed supply band 24 (FIG. 2) of deformable metal or metal alloy material having a continuous first portion 26, a plurality of second portions 28 spaced therealong and integrally connected to the first portion 26, and a plurality of third portions 30 integrally connected to respective ones of the second portions 28. As is suggested in comparison between FIGS. 2 and 3, the third portions 30, when bent, driven and clinched around the insulation 22, subsequently become the strain relief portion 20; the second portions 28 of the supply band 24, when bent, driven and clinched around the wire or wires 18, subsequently becomes the connector portion 16 of FIG. 3; and the continuous portion 26 when severed, bend, driven and formed, subsequently becomes the terminal portion 14 of the disconnect terminal 12.

In that embodiment of the instant invention where the strain relief portion 20 is not employed, the preformed supply band 24 merely includes the continuous first portion 26 and the plurality of second portions 28 spaced therealong and integrally connected to the first portion 26.

Figure 2:
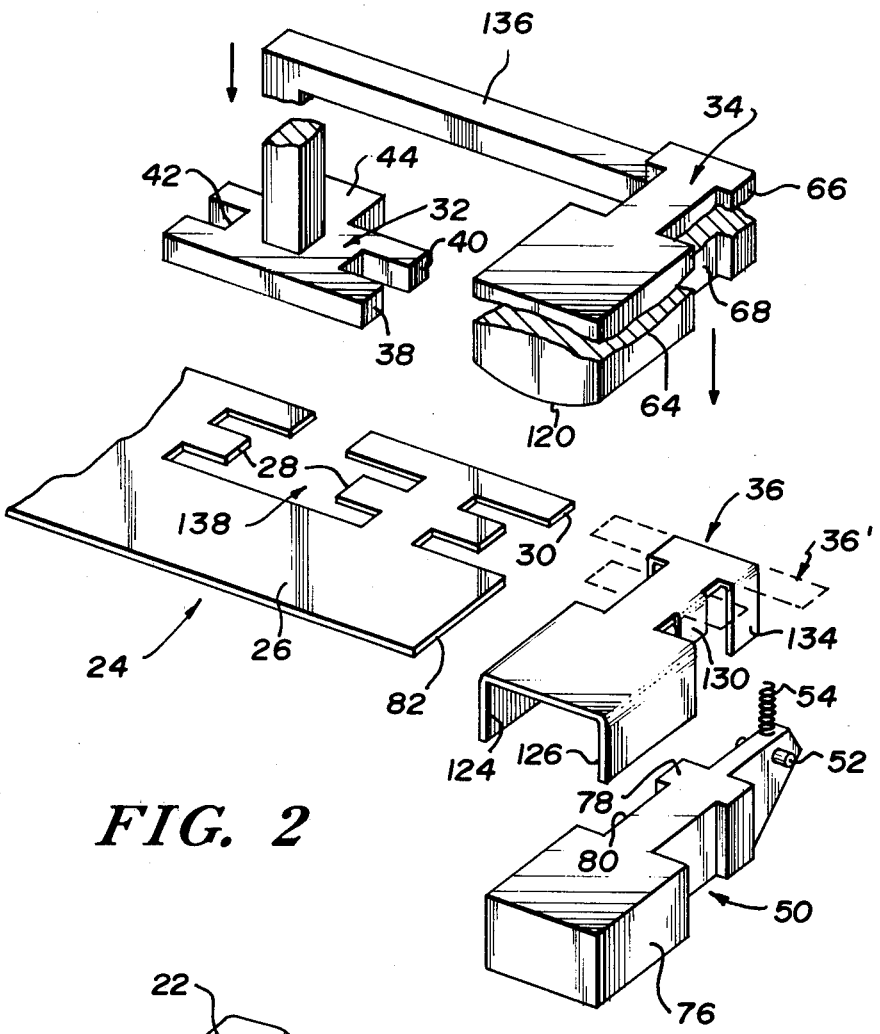
FIG. 2 is an exploded perspective view of a portion of the apparatus of the instant invention, and further illustrating an embodiment in which the supply band therefor is formed in situ from a continuous supply strip.

Alternatively, the supply stock may constitute a continuous planar band of deformable metal or metal alloy material which is formed in situ by the apparatus into the supply band illustrated in FIG. 2. As will be explained in greater detail, this may be accomplished by the employment of the generally H-shaped punching ram 32 which is connected to the driver 34 and operates to punch out the appropriate shape in the continuous supply band each time that the driver 34 descends to drive a previously formed U-shaped element 36 into the die 38 (FIG. 1) positioned therebeneath.

In the embodiment where strain relief portion 20 is being formed and the supply strip is being punched in situ, the H-shaped punching ram 32 includes a first leg 38 generally parallel to the longitudinal edges of the supply strip and disposed intermediate said edges, a second leg 40 parallel to the first leg and disposed between the first leg and one of the edges of the strip, joining portion 42 transverse to the leg portions 38 and 40 and joining same, and an edge portion 44 extending from the second leg 40 and intersecting the far edge (as viewed in FIG. 2) of the longitudinal supply strip. Of course, in an embodiment of the invention where the strain relief portion 20 is not being formed, the second leg of punching ram 32 is eliminated and the transverse portion 42 merely extends all the way to the far end of the supply strip as viewed in FIG. 2.

To facilitate further explanation, the invention will be described as employing a continuous planar supply strip as the starting material, which strip will be punched by the ram 32 shown in FIG. 2 to form the disconnect terminal 12 illustrated in FIGS. 3 and 4 with the strain relief portion 20 as a portion thereof.

Returning to FIG. 1, the apparatus 10 includes a pair of vertically reciprocating bending tools 46 and 48 between which is reciprocally mounted the aforenoted driving ram 34 (shown alone in FIG. 2). Positioned therebeneath is an anvil 50 pivotally mounted on the frame (not shown) by pivot pin 52 and normally biased to the position shown in FIG. 2 by a spring 54. Positioned therebeneath is the aforenoted clencher die 38, the details of which will be further explained. Adjacent the bending tools is a cutter block 56 having a slot 58 there through through which the supply strip 24 may be incrementally fed from a coiled supply of such supply strip by appropriate feeding mechanism not shown for sake of drawing clarity. As explained in greater detail in the aforementioned U.S. Pat. No. 3,636,611, the descending bending bars 46, 48 and the driver ram 34 reciprocally mounted therebetween are driven by a pair of links connected to the common crank output of a drive shaft electrically powered through a single revolution clutch. As is well known, the linkage is such that the bending tools 46, 48 descend first followed thereafter by the descent of the driving ram 34. Although the sequence of operations of this type of machine is known, it is thought worthwhile to initially review the general overall operation of this type of apparatus.

First, the feeding means incrementally feeds a length of the supply strip 24 through the cutter block 56 so that a length of the supply strip 24 ends up resting on the anvil 50. Next, the bending bars 46, 48 descend and during their descent, the edge 60 of the bending member 46 coacts with the edge 62 of the cutter block 56 to shear the length of supply strip 24 resting on the anvil 50 from the remainder of the supply strip. Continued downward travel of the bending bars 46 and 48 bends the severed length of supply strip around the anvil 50 into a generally U-shaped configuration. During this bending operation, the spring 54 (FIG. 2) is sufficiently strong to maintain the anvil 50 in its normal upright position.

Finally, the driving ram 34 descends to drive the U-shaped length into the die 38 positioned therebeneath. During the downward travel of the ram 34, the anvil 50 is pivoted out of the way of the descending ram. As the U-shaped length enters the die 38, it is crimped about the wires to be joined which have been previously laid in the cavity of the die 38.

So far as the instant invention is concerned, and disregarding for a moment the manner in which the supply band 24 is formed into the configuration illustrated in FIG. 2, (that is, whether it is preformed or formed in situ by the punching ram 32), it will be seen that the bending tools 46 and 48 and the driver ram 34 vertically mounted therebetween, are so machined relative to each other to produce the driver ram 34 shaped in the manner illustrated in FIG. 2. Thus, the driving ram 34 includes an enlarged front portion 64, enlarged rear portion 66, and transverse portion 68 joining the portions 64 and 66. Likewise, considering FIG. 1, it will be seen that it necessarily follows that the bending tools 46 and 48 define an enlarged opening 70, in the forward portion thereof, an enlarged portion 74 joining the openings 70 and 72. Of course, the driving ram 34 fits in the aforementioned openings defined between the two bending tools 46 and 48.

Further in accord with the invention, the aforementioned anvil 50 includes an enlarged forward portion 76, an enlarged rear portion 78, and a transverse portion 80 joining the portions 76 and 78.

Figure 5:
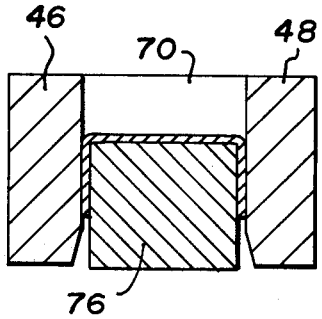
FIGS. 5, 6 and 7 are partial sectional views illustrating the bending of a severed length of a supply band into a generally U-shaped configuration about the three portions of the anvil employed in the apparatus of the invention.
Figure 6:
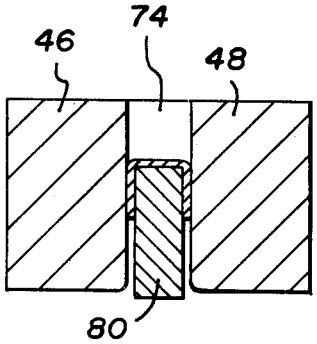
Figure 7:
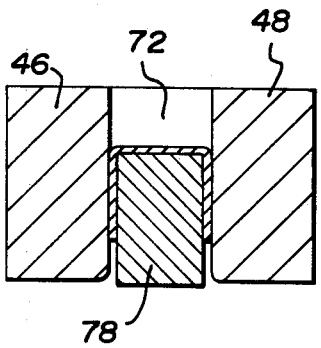

Thus, and assuming that the feeding mechanism has advanced the supply strip to a point at which a length 36' (shown in phantom in FIG. 2) is resting on the anvil 50, the first thing to occur is that the bending tools 46 and 48 descend, and the outer edge 60 of the bending tool 46 coacts with edge 62 of cutter block 56 to sever the length 36' from the remainder of the supply strip 24 by severing the continuous first portion 26 thereof along the line 82. Continued downward descent of the bending bars 46 and 48 bends the severed length 36' (illustrated in phantom in FIG. 2) around the anvil 50 into the U-shaped configuration shown in solid line fashion as 36 in FIG. 2. This operation is more clearly shown in FIGS. 5, 6 and 7 wherein in FIG. 5, the forward terminal portion of the U-shaped element 36 is seen being bent around the large forward portion of the anvil 50; in FIG. 6, the intermediate connector portion of the terminal is being bent around a narrow neck portion 80 of the anvil 50; and in FIG. 7, the rear portion of the severed length is being bent around the rear enlarged portion 78 of the anvil 50.

Figure 8:
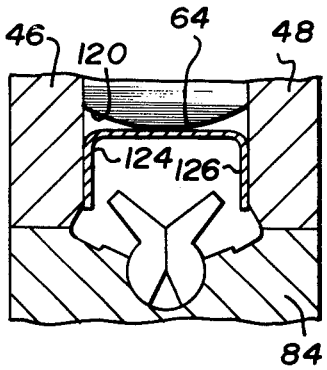
FIGS. 8, 9 and 10 illustrate a condition of the apparatus in which the three portion driving ram has begun to drive the U-shaped member into the die position therebeneath, while further illustrating the fact that the aforementioned anvil has been pivoted out of the way of the descending driver.
Figure 9:
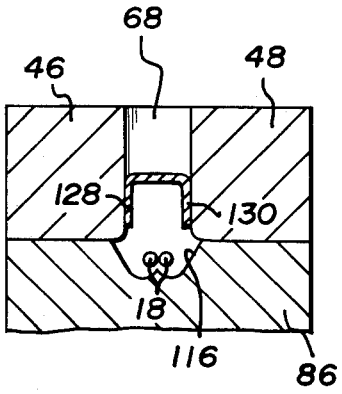
Figure 10:
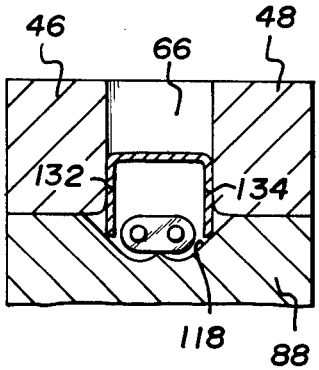

The next phase of the operation is illustrated most clearly in FIGS. 8, 9 and 10. Here, the driving ram 34 has descended to begin driving the U-shaped member 36 into the die 38, while at the same time pivoting the anvil 50 out of the path of downward travel of the ram 34. In FIG. 8, the enlarged forward portion 64 of the driving ram 34 is engaging the terminal portion of the U-shaped member 36; in FIG. 9, the narrow portion 68 of the driving ram 34 is engaging the connector portion of U-shaped member 36; while in FIG. 10, the rear enlarged portion 66 of the driving ram 34 is engaging the rear enlarged strain relief portion of the U-shaped terminal 36.

Figure 14:
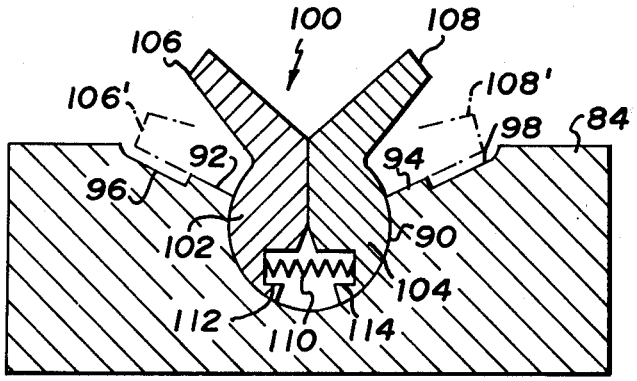
FIG. 14 is an enlarged sectional view of a portion of the novel die hereof.

The clenched die 38 is seen to comprise three portions 84, 86 and 88. The first portion 84 shown in enlarged fashion in FIG. 14, includes a circular recess 90, flared stop shoulders 92, 94, and recesses 96 and 98 stepped down from the respective stop shoulders 92 and 94. Rotatably positioned in the circular recess 90 is a male form 100 comprising first and second half forms 102 and 104, each including an ear portion 106 and 108 respectively. A small compression spring 110 whose opposite ends are positioned in recesses 112 and 114 in the half forms 102 and 104, respectively, biases the half forms toward the position illustrated in FIG. 14 (and FIG. 8). For reasons to become apparent, this is designated the eject position.

The second portion 86 of the die 38 includes a die cavity 116 (most clearly shown in FIG. 9) of double cusp configuration, with each cusp designed to receive one of the wires 118 which the connector portion 16 of the terminal 12 will be subsequently crimped about. A third portion 88 of the die 38 likewise includes a double cusp cavity 118 somewhat larger than the double cusp cavity 116 and so dimensioned as to receive the insulated portion 22 of the wire or wires.

Figure 11:
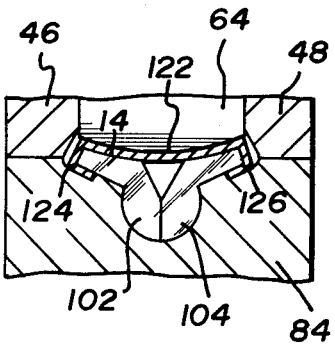
FIGS. 11, 12 and 13 illustrate the driver performing the final step of driving the various portions of the disconnect terminal formed in accordance with the instant invention into the respective portions of the die positioned therebeneath.
Figure 12:
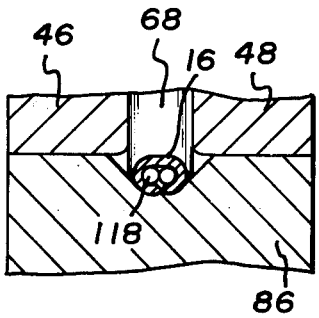
Figure 13:
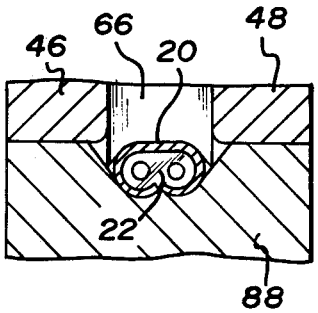

Continuing with the sequence of operations, as the ram 34 continues with its final descent illustrated in FIGS. 11, 12 and 13, the U-shaped member 36 is driven into the die 38 with the following operations taking place simultaneously. First, the convex undersurface 120 of the forward portion 64 of the ram 34 causes the crown portion 122 of the terminal portion 14 to spread the ears 106 and 108 (against the bias of the spring 110) to their phantom line configuration illustrated at 106' and 108' in FIG. 14 (also shown in FIG. 11). At the same time, the crown portion 122 assumes the concave configuration illustrated in FIG. 11. Simultaneously, the leg portions 124 and 126 of the terminal portion 14 of U-shaped member 36 enter the recesses 96 and 98 (see FIG. 14) defined behind the ear portions 106' and 108' now in their form position. As the leg portions are driven further down the recesses 96 and 98, they assume the configuration shown in FIG. 11.

Simultaneously, the mid-portion 68 of the driving ram 34 drives the connector portion 16 of the U-shaped member 36 into the die 116 of the second portion 86 of the die 38. As the driving continues, the leg portions 128 and 130 are driven around the wire or wires 18 previously laid in the cavity to crimp the connector portion 16 to the wire or wires 18.

At the same time, the rear enlarged portion 66 of the driver ram 34 drives the leg portions 132 and 134 of the strain relief portion 20 of the terminal 12 into the enlarged die cavity 118 in the third portion 8 of the die cavity 38 to crimp the strain relief portion 20 about the insulated portion 22 of the wire or wires.

Thus, it can be seen that in one simple, quick and automatic operation, the blank 36' has been sheared from the remainder of the supply strip 24; the blank 36' has been bent into the U-shaped configuration 36; and the U-shaped member 36 has been driven into the cavity 38 to form the disconnect terminal illustrated in FIGS. 3 and 4.

Finally, with respect to that embodiment of the instant invention in which the supply strip 24 is actually punched in situ, it is noted that the aforementioned punching ram 32 is linked by a connecting member 136 to the driving ram 34. Thus, each time the ram 34 descends, to drive a previously formed U-shaped member 36, the punching ram 36 simultaneously descends to form the appropriate opening 138 to establish the aforementioned second and third portions 28 and 30 of the supply strip 24. With reference to FIG. 1, it is noted the cutter block 56 includes the longitudinal passageway 140 therethrough to accommodate the vertical reciprocation of the H-shaped punching ram 32.

After the terminal 12 is formed in the aforedescribed manner, the parts operate in reverse sequence. Of course, as the driving ram 34 retracts, the compression spring 110 urges the two half forms 106 and 108 back toward their eject position, making it relatively easy to withdraw the terminal portion 14 of the disconnect terminal 12 therefrom.

It will be understood that if only one wire such as 118 has been employed, the leg 130 of the connector portion of the terminal will still crimp itself firmly around that wire, and in like fashion, the leg 134 of the strain relief portion of the terminal will likewise crimp itself firmly around the insulation 22 associated with that wire. The net effect will be that a hollow empty space will be defined within the curled legs 128 and 132, such legs assuming the same shape that they would have assumed had a wire 118 and a corresponding portion of insulation 22 been included in the respective die cavities.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed:

1. Apparatus for forming and crimping a disconnect terminal from a supply band having a continuous first portion and a plurality of second portions spaced therealong and integrally connected to said first portion; said apparatus comprising:

first means for shearing said continuous first portion of said supply band at a location intermediate two adjacent second portions thereof to form a predetermined length of said supply band into a predetermined shape having a terminal portion and an integrally connected connector portion;

second means for bending said length into a generally U-shaped configuration;

a die having a first and second receptacle therein; said first receptacle having a first predetermined configuration for the reception of at least one wire therein, said second receptacle having a second predetermined configuration established by a male form positioned therein for forming said terminal portion of said length into a preselected terminal configuration, said male form being the conplementary shape of said terminal configuration and being movable relative to said second receptacle from a first position to a second position to form said terminal portion; and third means for driving said length into said die whereby said connector portion of said length will be crimped about said wire received in said first receptacle and said terminal portion of said length will be formed into said preselected terminal configuration in said second receptacle.

2. The apparatus of claim 1 wherein said second means includes a pair of spaced apart vertically movable forming members.

3. The apparatus of claim 2 wherein said third means includes a driver member vertically movable in a path of movement defined between said spaced apart forming members.

4. The apparatus of claim 2 wherein said supply band is incrementally fed through a cutter block into predetermined position with respect to said second means; and said first means comprises one edge of said cutter block and one edge of one of said forming members.

5. The apparatus of claim 1 wherein said supply band further includes a plurality of third portions integrally connected to respective ones of said second portions of said supply strip; said predetermined length of said band formed by said first means further having a strain relief portion extending from said connector portion in a direction opposite said terminal portion, said die further including a third receptacle for the reception of the insulated portion of said wire therein and the reception of said strain relief portion of said length for crimping about said insulated portion of said wire.

6. The apparatus of claim 5 wherein said male form includes oppositely directed ear portions about which said terminal portion of said length is bent to form said preselected terminal configuration.

7. The apparatus of claim 6 wherein said male form comprises first and second half forms, each including one of said ear portions.

8. The apparatus of claim 7 wherein said first and second half forms are rotatably mounted in said second receptacle between an eject position and a form position.

9. The apparatus of claim 8 including biasing means for urging said half forms toward their eject position; said third means urging said half forms towards their form position when said length is driven into said die.

10. The apparatus of claim 1 wherein said male form includes oppositely directed ear portions about which said terminal portion of said length is bent to form said preselected terminal configuration.

11. The apparatus of claim 10 wherein said male form comprises first and second half forms, each including one of said ear portions.

12. The apparatus of claim 11 wherein said first and second half forms are rotatably mounted in said second receptacle between an eject position and a form position.

13. The apparatus of claim 12 including biasing means for urging said half forms toward their eject position; said third means urging said half forms toward their form position when said length is driven into said die.

14. The apparatus of claim 1 and further including forming means for sequentially forming a continuous supply strip into said supply band.

15. The apparatus of claim 14 wherein said forming means comprises punching means for forming a cut-out region in said supply strip.

16. The apparatus of claim 15 wherein said punching means is connected to said third means for operation therewith.

17. The apparatus of claim 14 wherein said forming means comprises punching means for forming a cut-out region in said supply strip; said punching means comprises a punching ram reciprocally movable with respect to a complementary shaped guideway provided in a cutter block.

18. The apparatus of claim 17 wherein said ram includes a stem portion and a top portion transversely oriented with respect to said stem portion; said stem portion intersecting at least one longitudinal edge of said supply strip; said top portion of said ram intersecting said supply strip intermediate the longitudinal edges of said supply strip so as to leave said continuous portion of said preformed supply band and said plurality of integrally connected second portions.

19. The apparatus of claim 18 wherein said punching means is connected to said third means for operation therewith.

20. The apparatus of claim 5 and further including forming means for sequentially forming a continuous supply strip into said supply band.

21. The apparatus of claim 20 wherein said forming means comprises punching means for forming a cut-out region in said supply strip.

22. The apparatus of claim 21 wherein said punching means is connected to said third means for operation therewith.

23. The apparatus of claim 20 wherein said forming means comprises punching means for forming a cut-out region in said supply strip.

24. The apparatus of claim 23 wherein said ram is of generally H-shaped cross section, having a first leg generally parallel to the longitudinal edges of said supply strip and disposed intermediate said edges, a second leg parallel to said first leg and disposed between said first leg and one of said edges, a joining portion transverse to said leg portions and joining same, and an edge portion extending from said second leg to said one of said edges.

* * * * *

UNITED STATES PATENT OFFICE

CERTIFICATE OF CORRECTION

Patent No. 3,991,452 Dated November 16, 1976

Inventor(s) Irwin Zahn and Renate Rosenberg

It is certified that error appears in the above-identified patent and that said Letters Patent are hereby corrected as shown below:

Column 3, line 50, delete "provide" and substitute therefor -- provided --.

Column 4, line 12, delete "bend" and substitute therefor -- bent --.

Column 7, line 4, delete "8" and substitute therefor -- 88 --.

Column 7, line 23, after "noted", insert -- that --.

Column 8, line 6, delete "conple-" and substitute therefor -- comple- --.

Signed and Sealed this

Fifteenth Day of March 1977

[SEAL]

*Attest:*

RUTH C. MASON
*Attesting Officer*

C. MARSHALL DANN
*Commissioner of Patents and Trademarks*